US008443992B2

(12) United States Patent
Lawson et al.

(10) Patent No.: US 8,443,992 B2
(45) Date of Patent: May 21, 2013

(54) INDUSTRIAL FRAME RACK SUPPORT ASSEMBLY

(75) Inventors: Alan Lawson, San Diego, CA (US); Steve Painter, San Diego, CA (US)

(73) Assignee: Whalen Furniture Manufacturing, Inc. a California corporation, San Diego, CA (US)

( * ) Notice: Subject to any disclaimer, the term of this patent is extended or adjusted under 35 U.S.C. 154(b) by 210 days.

(21) Appl. No.: 12/887,024

(22) Filed: Sep. 21, 2010

(65) Prior Publication Data

US 2012/0067838 A1 Mar. 22, 2012

(51) Int. Cl.

| | |
|---|---|
| ***A47B 57/06*** | (2006.01) |
| ***A47B 57/16*** | (2006.01) |
| ***A47B 57/40*** | (2006.01) |
| ***A47B 57/402*** | (2006.01) |
| ***A47B 47/021*** | (2006.01) |

(52) U.S. Cl.
USPC ..... 211/190; 211/191; 211/187

(58) Field of Classification Search
USPC .. 211/103, 187, 189, 190, 191, 183; 248/235, 248/247, 248, 250; 52/317, 653.1, 846; 108/147.15, 107, 181, 187
See application file for complete search history.

(56) References Cited

U.S. PATENT DOCUMENTS

| | | | | |
|---|---|---|---|---|
| 3,042,221 | A * | 7/1962 | Rasmussen | 211/183 |
| 3,463,325 | A | 8/1969 | Zagotta et al. | |
| 3,601,346 | A * | 8/1971 | Fenwick et al. | 248/188.1 |
| 4,078,664 | A | 3/1978 | McConnell | |
| 4,101,233 | A | 7/1978 | McConnell | |
| 4,261,470 | A * | 4/1981 | Dolan | 211/191 |
| 4,665,838 | A * | 5/1987 | Minshall | 108/186 |
| 4,955,490 | A * | 9/1990 | Schafer | 211/187 |
| 5,011,031 | A | 4/1991 | Konstant | |
| 5,012,938 | A * | 5/1991 | King | 211/191 |
| 5,189,857 | A * | 3/1993 | Herren et al. | 52/317 |
| 5,279,430 | A | 1/1994 | Benton | |
| 5,279,431 | A * | 1/1994 | Highsmith et al. | 211/189 |
| 5,310,066 | A | 5/1994 | Konstant | |
| 5,628,415 | A * | 5/1997 | Mulholland | 211/189 |
| 5,636,755 | A * | 6/1997 | Guiher | 211/183 |
| 5,735,411 | A * | 4/1998 | Flamme et al. | 211/26 |
| 6,105,798 | A | 8/2000 | Gruber et al. | |
| 6,189,707 | B1 | 2/2001 | Meyers et al. | |
| 6,260,318 | B1 * | 7/2001 | Herren | 52/317 |
| 6,425,558 | B1 | 7/2002 | Saunders | |
| 6,520,357 | B1 * | 2/2003 | Kautz et al. | 211/191 |

(Continued)

OTHER PUBLICATIONS

"Wide Span Shelving Units" L K. Goodwin Co., http://www.lkgoodwin.colm/more_info/wide_span_shelving_units/wide_span_shelving_units.shtml (accessed Aug. 4, 2010).

*Primary Examiner* — Jennifer E Novosad
(74) *Attorney, Agent, or Firm* — Barlow, Josephs & Holmes, Ltd.

(57) ABSTRACT

A storage rack system is provided that includes an improved cross bar attachment to create the framing for storage shelves. The cross bars are locked or secured against undesired movement and rolling to create a shelf that properly supports loads. The cross bars extend between the deck beams such that flanges at the ends thereof overlap the top of the deck beams. The flanges include a tab that extends downwardly to engage with an opening on the top of the deck beams. The lateral support further includes a stabilizer that is fastened to the side wall of the deck beams to prevent rolling or dislodgement of either member.

5 Claims, 4 Drawing Sheets

U.S. PATENT DOCUMENTS 7,614,511 B2 11/2009 Konstant
7,748,546 B2 7/2010 Konstant
7,753,220 B2 7/2010 Konstant
2003/0155319 A1* 8/2003 Wishart et al. ..... 211/189
2007/0246434 A1* 10/2007 Adams et al. ..... 211/8

* cited by examiner

INDUSTRIAL FRAME RACK SUPPORT ASSEMBLY

BACKGROUND OF THE INVENTION

The present invention relates generally to shelf-type storage rack systems. More particularly, the present invention relates to the support framing system and an improved cross bar attachment used to create the framing for storage shelves. The cross bars of the present invention are locked or secured against undesired movement and rolling to create a shelf that properly supports loads. Further, the locking cross bars are also readily removable and reusable.

Shelf-type storage racks are widely known in the art. Various racking systems can be seen throughout the residential storage, retail sales and warehouse industry. Typical shelf-type storage racks include at least four vertical columns rigidly interconnected by generally horizontal deck beams which are positioned in a transverse relation between opposing pairs of columns. These columns are then spaced apart in a parallel relationship by cross bars and often diagonal members. Shelves are then supported upon the horizontal deck beams and the cross bars. As is typical in known, shelf-type systems, a series of wooden slats or plywood decking is placed between the opposing deck beams to form shelves where pallets and other loads may be stored and accessed by warehouse personnel. The front of the shelf is usually adjacent to an access aisle, where warehouse personnel typically use high lifts, fork lifts and the like to place and remove pallets and their loads from the shelves.

As indicated above, one common way of creating the storage shelves is the use of wooden slats, typically two-by-fours, that extend between the deck beams. When using this method, the front and back deck beams are typically roll formed prior to installation to provide a ridge or lip on their upper surface upon which the wooden slats are placed. However, in this configuration, the slats are prone to being knocked-out, skewed or otherwise misaligned between the deck beams. If this shifting or knock-out of one or more slats is unknown to the warehouse personnel, subsequent placement of a load could result in the load falling, leading to injury to the personnel and/or damages to the load, equipment or rack structure. At best, making sure that the slats are properly positioned between the deck beams is time consuming for the warehouse personnel. In another method of creating storage shelves, wooden slats are inserted in the channels between the opposing deck beams. Although an improvement, this method has disadvantages such as increased construction costs and decreased flexibility.

In the past, it has been found that where a decking panel structure has been installed in a shelving rack structure, there is some tendency for the deck beams and cross bars supporting the shelving rack structure to bow in such a way that the structural members tend to roll and/or move apart. Where the load is heavy enough, the decking panel structure comprising the wood or steel decking, as a result of the movement of the structural members, tends to drop off of the beams. In order to overcome such movement, often rack frames must be welded or attached together by bolts, for simple assembly and disassembly. While welded racks may be strong, they cannot be easily disassembled for moving and the labor involved in welding them together is substantial. Bolted racks, while easily assembled, exhibit the additional problem that any looseness in the beam to column connection will result in a leaning, wobbling rack. This in turn induces higher stresses in many of the components which might cause collapse of a heavily loaded rack.

Also, problems may arise because of irregularities in the floor of the warehouse or other place where the rack is positioned. This, along with small errors in the length and width of the beams and columns as well as the positioning of bolt holes therein, can result in the creation of unpredictable positional variations in the beams and columns as one attempts to affix them together. This, in turn, may create significant difficulties in getting a tightly bolted connection between the beams and columns, since the parts may not quite fit precisely together because of the unpredictable positional variations.

There is therefore a need for an improved system for attaching the structural members of a shelving rack support frame. There is a further need of an improved cross bar attachment used to create the framing for storage shelves. Still further there is a need for cross bars that are readily removable and reusable yet can be locked or secured against undesired movement and rolling to create a shelf that properly supports loads.

BRIEF SUMMARY OF THE INVENTION

In this regard, the present invention provides for an improved shelf-type storage rack system that includes an improved cross bar attachment that is used to create the framing for storage shelves. The cross bars of the present invention are locked or secured against undesired movement and rolling to create a shelf that properly supports loads Further, the locking cross bars are also readily removable and reusable.

Generally, the shelf-type storage rack of the present invention includes at least four vertical columns. Pairs of the columns are rigidly interconnected to one another by generally horizontal deck beams that are positioned in a transverse relation between opposing pairs of the columns. These pairs of columns that support the deck beams are then spaced apart in a parallel relationship and supported relative to one another by cross bars extending between the deck beams. Shelves are then supported upon the horizontal deck beams and the cross bars.

The cross bars extend between the deck beams such that flanges at the ends thereof overlap the top of the deck beams. The flanges include a tab that extends downwardly to engage with an opening on the top of the deck beams. The lateral support further includes a stabilizer that is fastened to the side wall of the deck beams to prevent rolling or dislodgement of either member.

It is therefore an object of the present invention to provide an improved system for attaching the structural members of a shelving rack support frame. It is a further object of the present invention to provide an improved cross bar attachment used to create the framing for storage shelves. It is still a further object of the present invention to provide cross bars that are readily removable and reusable yet can be locked or secured against undesired movement and rolling to create a shelf that properly supports loads.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
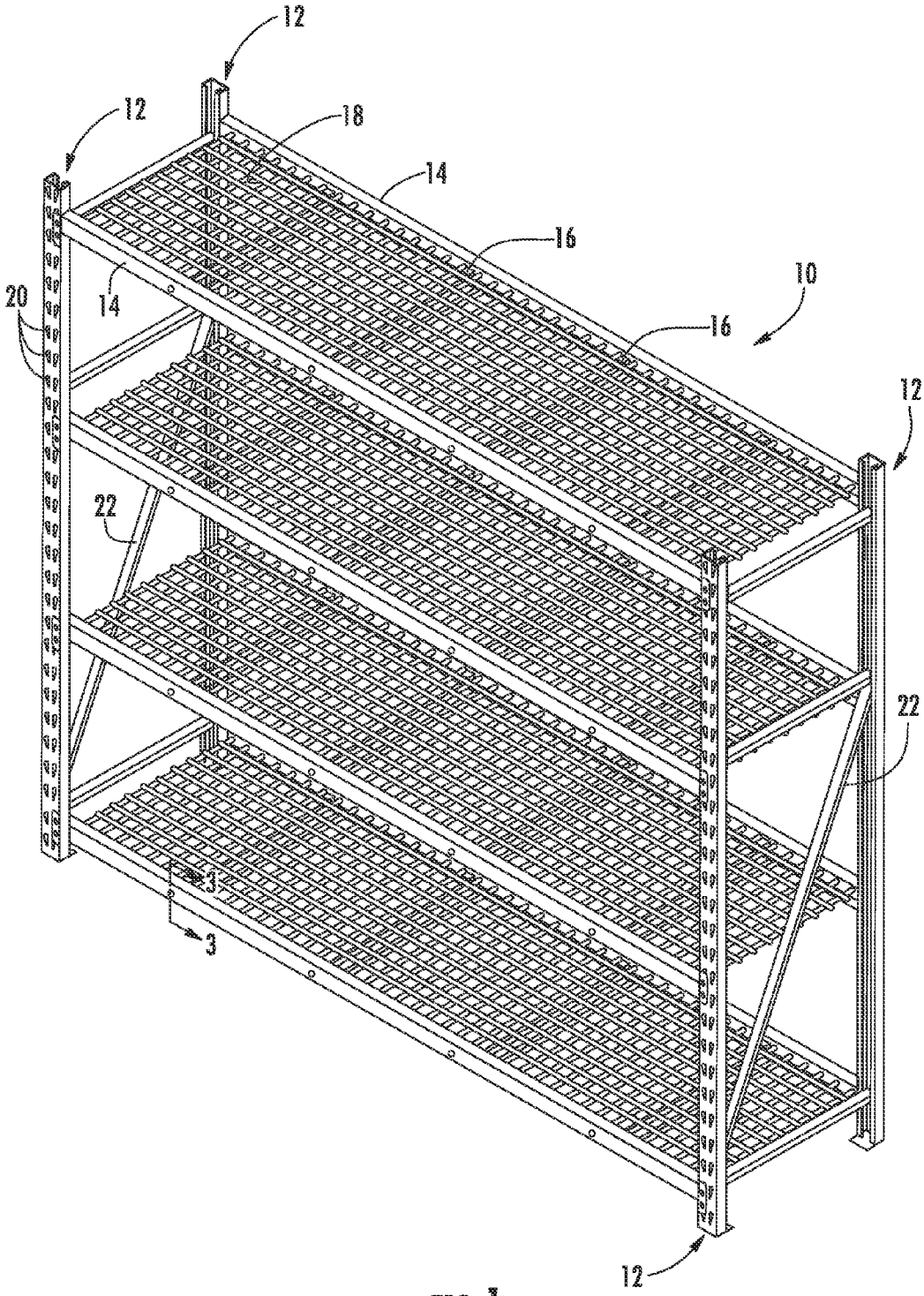
FIG. 1 is a front perspective view of the rack support frame of the present invention.

Now referring to the drawings, the improved shelf-type storage rack system is shown and generally illustrated in the figures. As can be seen the storage rack system includes an improved cross bar attachment that is used to create the framing for storage shelves. The cross bars of the present invention are locked or secured against undesired movement and rolling to create a shelf that properly supports loads Further, the locking cross bars are also readily removable and reusable.

As can be seen at FIG. 1, the shelf-type storage rack 10 of the present invention includes generally includes at least four vertical supports 12. The vertical supports 12 are generally arranged as a pair of rear vertical spaced supports and a pair of opposed, spaced front vertical supports. Each of the pairs of vertical supports is rigidly interconnected to one another by generally horizontal deck beams 14 that are positioned in a transverse relation between opposing pairs of the vertical support 12. The front and rear deck beams 14 extend between and are supported by each of the front and rear vertical supports 12 respectively. The front and rear pairs of vertical supports 12 that support the deck beams 14 are then spaced apart in a parallel relationship and supported relative to one another by cross bars 16 extending between and supported by the deck beams 14. Sheeting material 18 is then supported upon the horizontal deck beams 14 and the cross bars 16 to form shelving surfaces.

The vertical supports 12 are preferably formed from channel stock but may also be tube or angle stock and still fall within the scope of the present disclosure. The vertical supports 12 include a plurality of spaced apart openings 20 therein. The spaced apart openings 20 can be seen to be arranged in two columns on the face of the vertical supports 12. The spaced apart openings 20 are configured and arranged to receive engaging plates on the opposing ends of the deck beams 14 such that the engaging plates have formations that are received and retained within the openings 20 in a manner that affixes the ends of the deck beams 14 to the vertical supports 12 in a secure yet releasable fashion. In this manner the deck beams 14 are installed onto the opposing supports 12 at the desired height for the finished shelving. Two columns of openings are provided in order to allow each of the vertical supports 12 to support additional deck beams 14 in a manner that allows additional shelving units to be constructed adjacent one another without the need for redundant supports 12 that begin and end each adjacent shelving section.

It can also be seen that a diagonal member 22 may be provided to brace front vertical supports 12 relative to rear vertical supports 12. The use of such diagonal bracing is well known in the art to prevent swaying and tilting of shelving units and as such will not be further discussed in the context of this disclosure.

Figure 2:
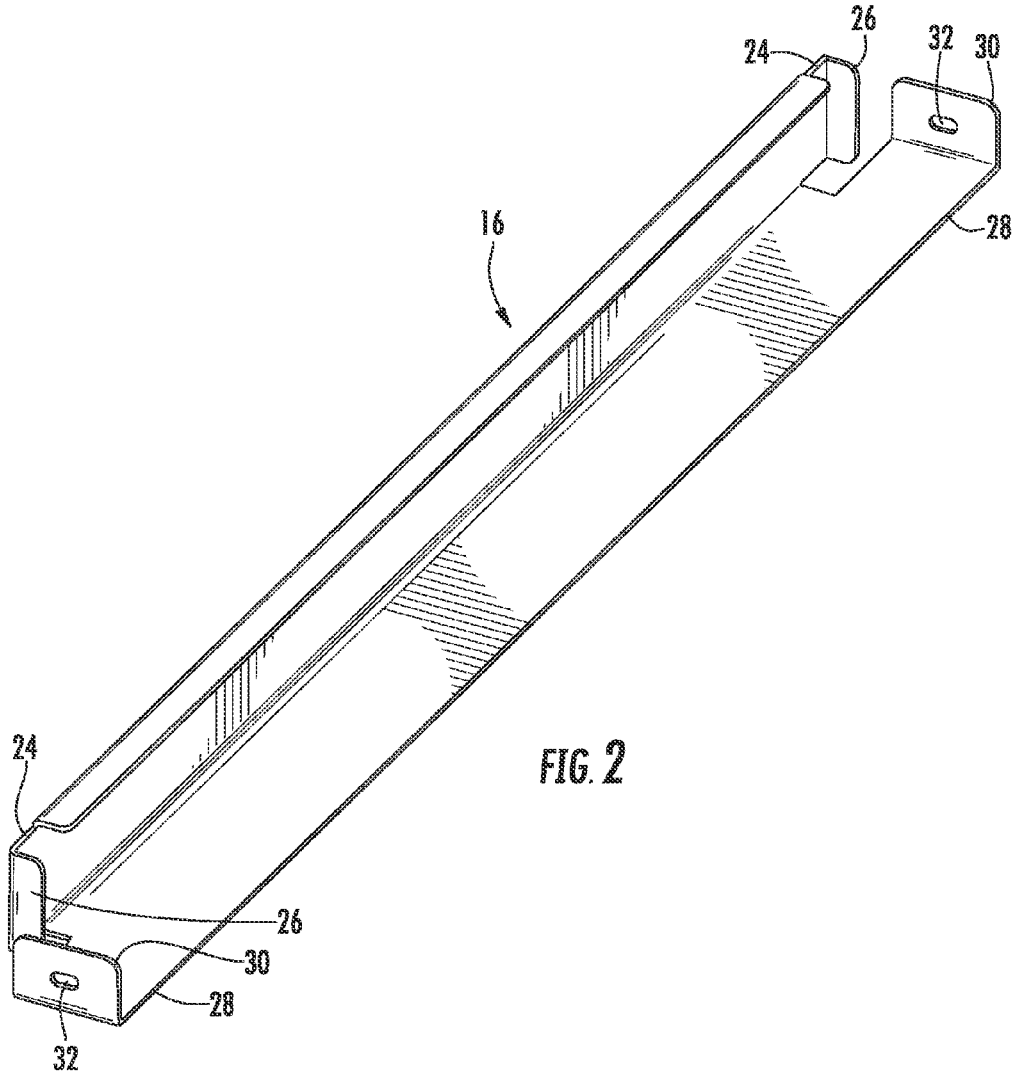
FIG. 2 is a perspective view of the cross bar of the present invention.

Turning now to FIG. 2 the cross bars 16 of the present invention can be seen to be formed as a generally channel shaped section. Each end of the said cross bar 16 generally includes a top flange 24 at front and rear ends thereof and tabs 26 that extend downwardly from the flanges 24. Further, the cross bars 16 include arms 28 at the front and rear ends that extend outwardly below the flanges 24. The ends of the arms 28 terminate in a tab 30 with openings 32 therein. The openings 32 allow fastening of the arms 28 to the deck beam 14 as will be described in more detail below.

Figure 3:
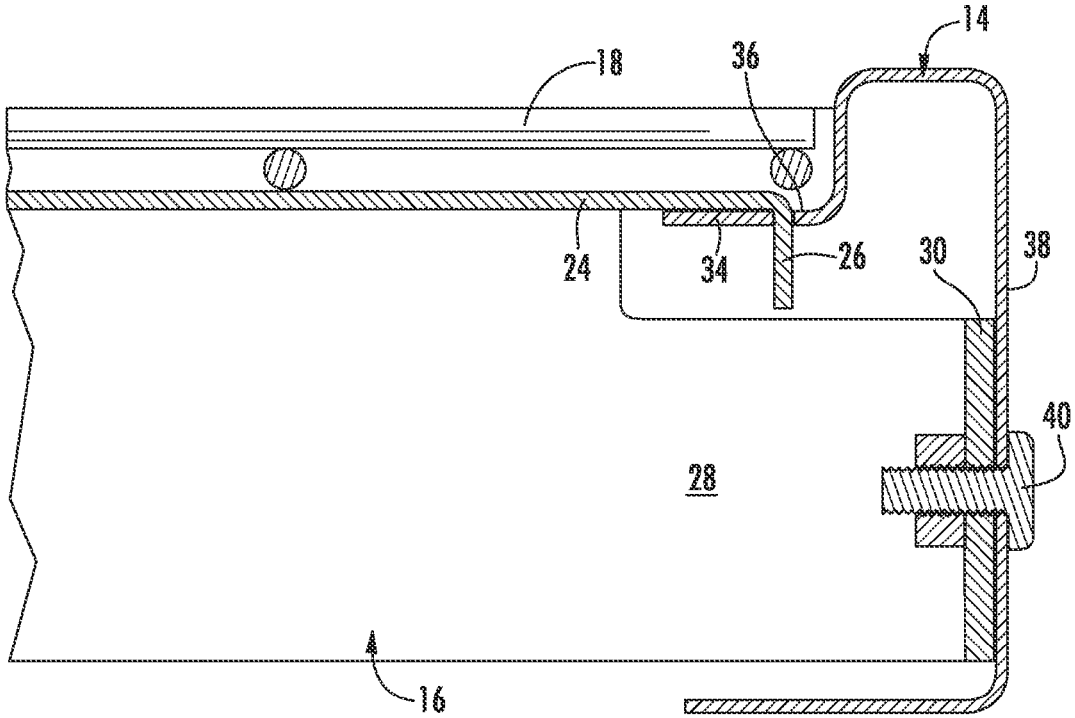
FIG. 3 is a cross sectional view taken along line 3-3 of FIG. 1.
Figure 4:
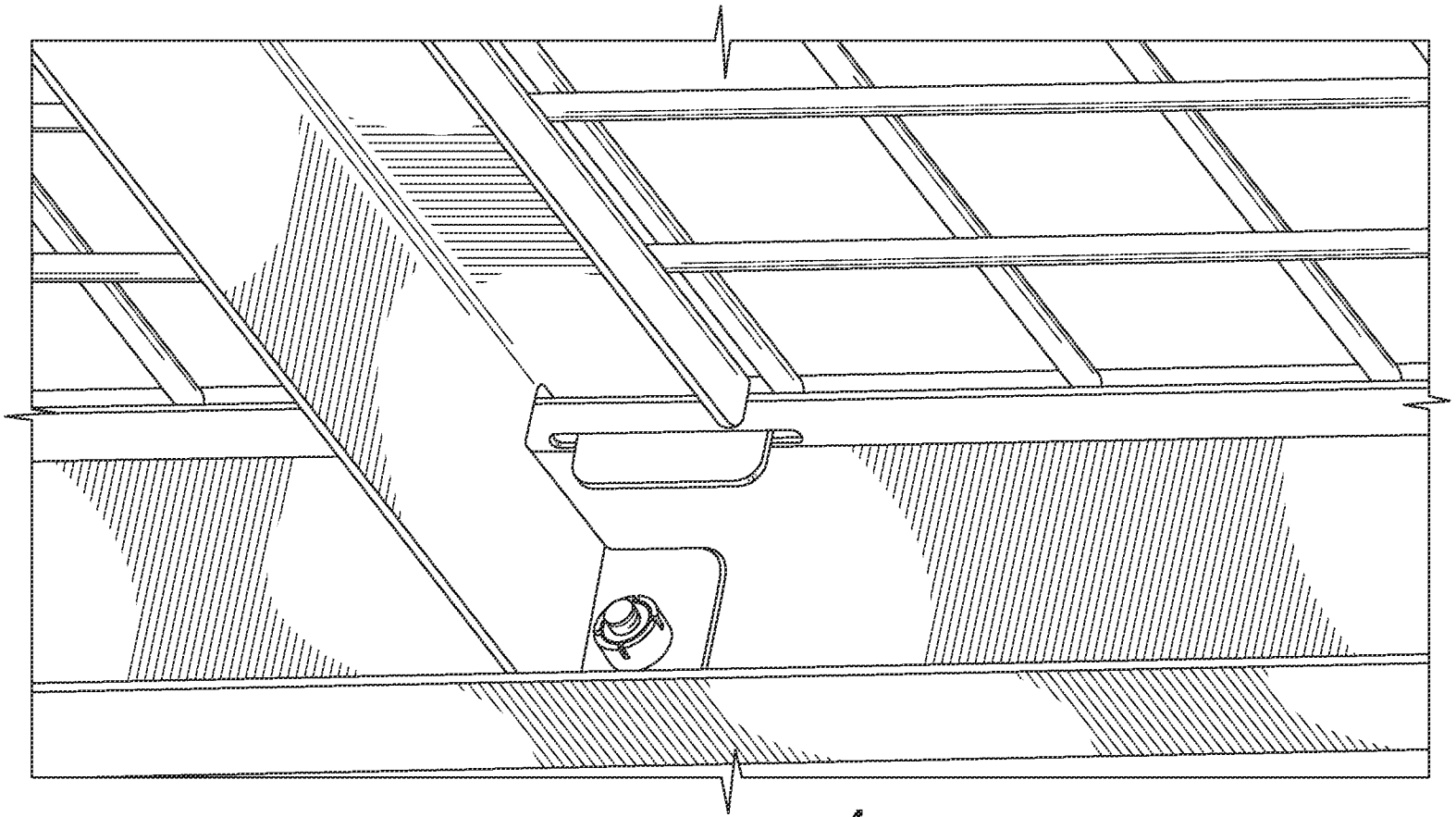
FIG. 4 is a bottom perspective view of the connection between the deck beam and the cross bar.

As can be seen in FIGS. 3 and 4 in combination, the cross bar 16 engages with the deck beams 14 in a unique manner as compared to the prior art. The cross bars 16 extend between the deck beams 14 such that flanges 24 at the ends thereof overlap the top surface of the deck beams 14. It is preferred, but not required, that the top surface of the deck beam include a lip 34 formed along the interior edge thereof such that the openings 36 are formed on the inner edge thereof. As was described above, the flanges 24 include a tab 26 that extends downwardly to engage with the opening 36 on the top of the deck beams 14. The cross bar 16 further includes a stabilizer arm 28 that extends outwardly to the side wall 38 of the deck beam 14 and is fastened to the side wall 38 of the deck beams 14 to prevent rolling or dislodgement of either member. It should be appreciated that while the deck beam 14 is shown here as channel stock, tube or box stock would work equally well. In a case where tube or box stock is used the stabilizer arm 28 would simply be adjusted in length relative to the flange 24 and tab 26 to allow for the change in position of the side wall 38 of the deck beam 14.

Fastening between the deck beam 14 and the stabilizer arm 28 may be accomplished using any known fastener 40 applicable is such an application. While a preferred fastener may include a bolt, this is meant to be illustrative and not limiting in any manner on the scope of the disclosure.

Sheeting material 18 is installed onto the assembly. The sheeting material may be any known sheeting material including but not limited to the preferred wire mesh shown herein. Should a lip 34 be provided on the top surface of the deck beam 14, the lip will be of a depth to make the finished surface of the sheeting material 18 flush with the top surface of the deck beam 14.

It can therefore be seen that the present invention provides an improved system for attaching the structural members of a shelving rack support frame using an improved cross bar attachment that is readily removable and reusable yet can be locked or secured against undesired movement and rolling to create a shelf that properly supports loads. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A cross bar for a support frame for a shelf assembly, said shelf assembly including a pair of rear vertical spaced supports, an opposed pair of spaced front vertical supports, and elongated front and rear deck beams extending between and supported by each of the front and rear vertical supports respectively, said deck beams having an outer vertical side wall, a horizontal top surface and a recessed horizontal lip extending inwardly from said top surface below the top surface to form an interior ledge, said recessed lip including a plurality of elongated openings extending parallel to a longitudinal extent of said deck beams, said cross bar comprising:

an elongated L-shaped body having a horizontally extending top flange and a vertically extending side arm, said top flange having front and rear ends and tabs extending downwardly from said front and rear ends, said front and rear ends of said top flange being seated on the recessed lip of said front and rear deck beams with said tabs being received into said elongated openings in said recessed lip, said vertically extending arm having front and rear ends and tabs extending inwardly from said front and rear ends, said inwardly extending tabs on said front and rear ends of said arm being received in facing engagement with an interior surface of side wall of said front and rear deck beams and being fastened thereto, wherein a sheeting material received and supported on said recessed lip is flush with said top surface of said deck beams to form a continuous planar shelf surface.

2. A cross bar for a support frame for a shelf assembly, said shelf assembly including a pair of rear vertical spaced supports, an opposed pair of spaced front vertical supports, and elongated front and rear deck beams extending between and supported by each of the front and rear vertical supports respectively, said deck beams having an outer vertical side wall, a horizontal top surface and a recessed horizontal lip extending inwardly from said top surface below the top surface to form an interior ledge, said recessed lip including a plurality of elongated openings extending parallel to a longitudinal extent of said deck beams, said cross bar comprising:

an elongated L-shaped body having a horizontally extending top flange and a vertically extending side arm, said top flange having front and rear ends and tabs extending downwardly from said front and rear ends, said front and rear ends of said top flange being seated on the recessed lip of said front and rear deck beams with said tabs being received into said elongated openings in said recessed lip, said vertically extending arm having front and rear ends and tabs extending inwardly from said front and rear ends, said inwardly extending tabs on said front and rear ends of said arm being received in facing engagement with an interior surface of side wall of said front and rear deck beams and being fastened thereto.

3. The cross bar of claim 2, further comprising a sheeting material received and supported on said recessed lip and said cross bar.

4. The cross bar of claim 3, wherein said sheeting material is a wire mesh sheet.

5. The cross bar of claim 3, wherein said sheeting material is supported such that a top surface of said sheeting material is flush with said top surface of said deck beams to form a continuous planar shelf surface.

* * * * *